US011538650B1

(12) United States Patent
Yang

(10) Patent No.: US 11,538,650 B1
(45) Date of Patent: Dec. 27, 2022

(54) AIR GAP DRIVING MECHANISM OF A SOLID-STATE CIRCUIT BREAKER INCLUDES PERMANENT MAGNET(S) FOR CONTACT SEPARATION

(71) Applicant: Siemens Industry, Inc., Alpharetta, GA (US)

(72) Inventor: Guang Yang, Johns Creek, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 17/451,871

(22) Filed: Oct. 22, 2021

(51) Int. Cl.
*H01H 71/32* (2006.01)
*H01H 71/10* (2006.01)

(52) U.S. Cl.
CPC ..... *H01H 71/323* (2013.01); *H01H 71/1072* (2013.01); *H01H 71/325* (2013.01)

(58) Field of Classification Search
CPC ..... H01H 71/2436; H01H 17/2454; H01H 71/2472; H01H 71/32–323
See application file for complete search history.

(56) References Cited

FOREIGN PATENT DOCUMENTS

DE 3133620 A * 3/1983 ..... H01H 71/323

* cited by examiner

*Primary Examiner* — Ramon M Barrera

(57) ABSTRACT

A solid-state circuit breaker comprises a breaker housing and an air gap driving mechanism that is a permanent magnet based. The air gap driving mechanism includes a pair of opposing contacts, a first permanent magnet to generate a static magnetic field and a coil actuator to generate a dynamic magnetic field. The first permanent magnet and the coil actuator are positioned relative to each other such that the dynamic magnetic field generated by the coil actuator can either enhance or cancel the static magnetic field of the first permanent magnet. Hence a combination of the static magnetic field from the first permanent magnet and the dynamic magnetic field from the coil actuator can either drive the pair of opposing contacts open or drive the pair of opposing contacts close.

20 Claims, 3 Drawing Sheets

AIR GAP DRIVING MECHANISM OF A SOLID-STATE CIRCUIT BREAKER INCLUDES PERMANENT MAGNET(S) FOR CONTACT SEPARATION

BACKGROUND

1. Field

Aspects of the present invention generally relate to an air gap driving mechanism of a solid-state circuit breaker that includes one or more permanent magnets for controlling contact separation.

2. Description of the Related Art

Solid-state circuit breakers have advantages such as fast interruption, easy integration to a control circuit and so on. However, one of the drawbacks of solid-state circuit breakers is that high voltage surges may breakdown solid-state components and cause damage to the breakers. Therefore, an integrated air gap is normally provided for isolation purpose to protect the solid-state components under such conditions. Traditional circuit breaker mechanisms can be scaled down to serve the purpose of air gap in many applications, but the sizes of such mechanisms are limited by the air separation needed and the sizes of the components required for strength and manufacturing requirements. Different air gap mechanisms that are more suitable for solid-state circuit breaker applications are needed to reduce the size and complexity. However, any traditional circuit breaker mechanisms that are often used for air gap purposes are generally inadequate.

Therefore, there is a need for a better air gap driving mechanism for a solid-state circuit breaker.

SUMMARY

Briefly described, aspects of the present invention relate to an air gap driving mechanism of a solid-state circuit breaker that includes one or more permanent magnets. This invention presents an air gap driving mechanism that is permanent magnet based, which provides the benefits of compact size, simple construction, remote controllability and breaker lockout in case of breaker failure. This disclosure proposes a mechanism that is less complex, easier to integrate with the rest of the electronics, and easier to control. The basic concept is to use combinations of a static magnetic field from a permanent magnet and a dynamic magnetic field from a coil actuator. The dynamic magnetic field generated by the coil actuator can either enhance or cancel the magnetic field of the permanent magnet, and hence the combination can either drive two opposite contacts open or drive the two opposite contacts close. There are different ways to achieve such configuration, an example is shown below.

In accordance with one illustrative embodiment of the present invention, a solid-state circuit breaker comprises a breaker housing and an air gap driving mechanism. The air gap driving mechanism includes a pair of opposing contacts, a first permanent magnet to generate a static magnetic field and a coil actuator to generate a dynamic magnetic field. The first permanent magnet and the coil actuator are positioned relative to each other such that the dynamic magnetic field generated by the coil actuator can either enhance or cancel the static magnetic field of the first permanent magnet. Hence a combination of the static magnetic field from the first permanent magnet and the dynamic magnetic field from the coil actuator can either drive the pair of opposing contacts open or drive the pair of opposing contacts close.

In accordance with one illustrative embodiment of the present invention, a method of controlling contact separation in an air gap driving mechanism is provided, The method comprises providing a breaker housing and providing an air gap driving mechanism including: a pair of opposing contacts, a first permanent magnet to generate a static magnetic field and a coil actuator to generate a dynamic magnetic field. The first permanent magnet and the coil actuator are positioned relative to each other such that the dynamic magnetic field generated by the coil actuator can either enhance or cancel the static magnetic field of the first permanent magnet. Hence a combination of the static magnetic field from the first permanent magnet and the dynamic magnetic field from the coil actuator can either drive the pair of opposing contacts open or drive the pair of opposing contacts close.

DETAILED DESCRIPTION

Figure 1:
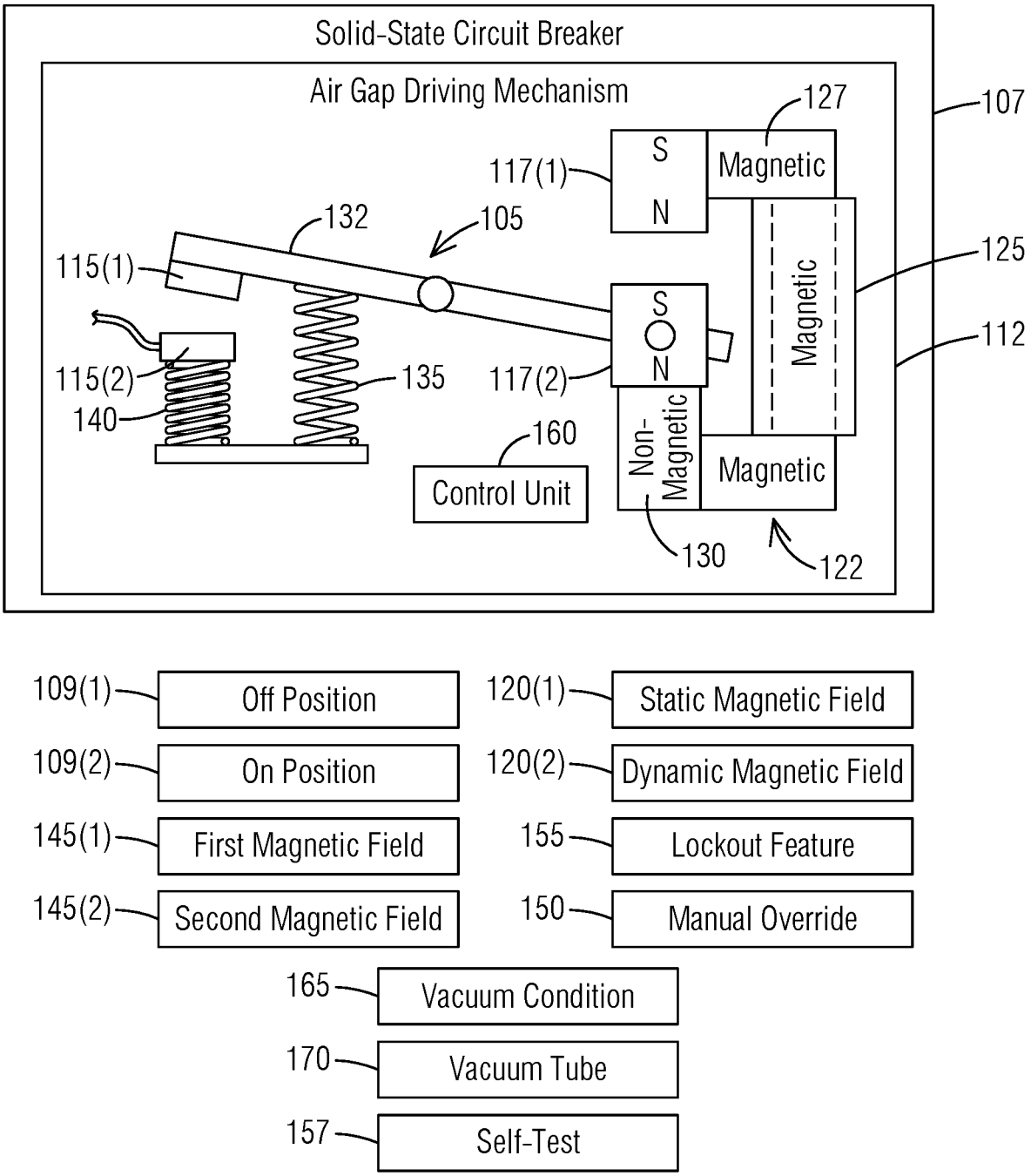
FIG. 1 illustrates an air gap driving mechanism in an OFF position (contacts open) in accordance with an exemplary embodiment of the present invention.

To facilitate an understanding of embodiments, principles, and features of the present invention, they are explained hereinafter with reference to implementation in illustrative embodiments. In particular, they are described in the context of an air gap driving mechanism of a solid-state circuit breaker that includes one or more permanent magnets for controlling contact separation. These circuit breaker mechanisms that are used for air gap purposes are generally adequate. Therefore, a better air gap driving mechanism for a solid-state circuit breaker is provided. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

These and other embodiments of the air gap driving mechanism for the solid-state circuit breaker according to the present disclosure are described below with reference to FIGS. 1-5 herein. Like reference numerals used in the drawings identify similar or identical elements throughout the several views. The drawings are not necessarily drawn to scale.

Consistent with one embodiment of the present invention, FIG. 1 represents an air gap driving mechanism 105 of a solid-state circuit breaker 107 in an OFF position 109(1) (contacts open) in accordance with an exemplary embodiment of the present invention. The solid-state circuit breaker 107 comprises a breaker housing 112 and the air gap driving mechanism 105. The air gap driving mechanism 105 includes a pair of opposing contacts 115(1-2), a first permanent magnet 117(1) to generate a static magnetic field 120(1), and a coil actuator 122 to generate a dynamic magnetic field 120(2).

The first permanent magnet 117(1) and the coil actuator 122 are positioned relative to each other such that the dynamic magnetic field 120(2) generated by the coil actuator 122 can either enhance or cancel the static magnetic field 120(1) of the first permanent magnet 117(1). Hence, a combination of the static magnetic field 120(1) from the first permanent magnet 117(1) and the dynamic magnetic field 120(2) from the coil actuator 122 can either drive the pair of opposing contacts 115(1-2) open or drive the pair of opposing contacts 115(1-2) close.

The coil actuator 122 consists of a coil 125 and a ferromagnetic core 127 and is fixed in the breaker housing 112. The first permanent magnet 117(1) is fixed to one end of the ferromagnetic core 127 and a non-magnetic stop 130 is attached to the other end.

The solid-state circuit breaker 107 further comprises a contact arm 132 that is pivotally mounted in the breaker housing 112 such that on one end of the contact arm 132 a second permanent magnet 117(2) is pivotally mounted. The second permanent magnet 117(2) can be attracted by the first permanent magnet 117(1) such that the second permanent magnet 117(2) provides stronger interaction with the first permanent magnet 117(1). On the other end of the contact arm 132 a contact of the pair of opposing contacts 115(1-2) is mounted which can close and open with a stationary contact of the pair of opposing contacts 115(1-2) to close and open a current path.

The solid-state circuit breaker 107 further comprises a reset spring 135 that acts on the contact arm 132 in a manner that it always tries to push the pair of opposing contacts 115(1-2) open for fail safe purpose. The solid-state circuit breaker 107 further comprises a contact force spring 140 that is loaded behind the stationary contact of the pair of opposing contacts 115(1-2) to provide a necessary contact force.

In the OFF position 109(1), the coil actuator 122 is not energized so the pair of opposing contacts 115(1-2) are held open by the reset spring 135. From the OFF position 109(1) if it is decided to close the pair of opposing contacts 115(1-2), the coil actuator 122 is energized with a current direction in such a way that a first magnetic field 145(1) is generated such that a magnetic field strength of the first permanent magnet 117(1) is enhanced so it can attract the second permanent magnet 117(2) to overcome the reset spring 135 and eventually to close the pair of opposing contacts 115(1-2).

With the first and the second permanent magnets 117(1-2) now in touch with each other a magnetic force between them is strong enough to overcome the reset spring 135 and the contact force spring 140 which can hold the pair of opposing contacts closed and the solid-state circuit breaker is then in an ON position 109(2). From the ON position 109(2) if it is decided to open the pair of opposing contacts 115(1-2), an opposite direction current is provided to the coil 125 to generate a second magnetic field 145(2) that is opposite to the first magnetic field 145(1) such that a coil magnetic field cancels a magnetic field of both the first and the second permanent magnets 117(1-2), and hence eliminate an attraction force between the two causing the reset spring 135 to then open the pair of opposing contacts 115(1-2).

The solid-state circuit breaker 107 further comprises a manual override 150 to manually push the second permanent magnet 117(2) away from the first permanent magnet 117(1) in the ON position 109(2) and hence to open the pair of opposing contacts 115(1-2) in case of electronics failure.

The solid-state circuit breaker 107 further comprises a lockout feature 155 in that before the pair of opposing contacts 115(1-2) are closed, a self-test 157 can be run to check the condition of components and circuitry and the pair of opposing contacts 115(1-2) can be closed through the coil actuator 122 only after the self-test 157 passes. In case of the self-test 157 failure, a control unit 160 of the solid-state circuit breaker 107 does not send current to the coil actuator 122 so the pair of opposing contacts 115(1-2) do not close.

The contact separation may be put inside a vacuum condition 165. The proposed design can be used in normal atmospheric pressure condition. However, if the contact separation is put inside the vacuum condition 165, a further reduction in mechanism size can be realized. Inside the vacuum condition 165, if a certain pressure is reached, much smaller contact separation is needed for the same isolation as in atmospheric pressure. Smaller separation results in smaller driving range for the coil actuator 122, and therefore reduces the size needed for the coil actuator 122. The second permanent magnet 117(2) can be mounted on the movable portion outside an end spring.

As another possibility, if the mechanism 105 is small enough, it can also be placed in a vacuum tube 170. For example, in one embodiment, the air gap driving mechanism 105 may be placed in the vacuum tube 170 as a whole.

Figure 2:
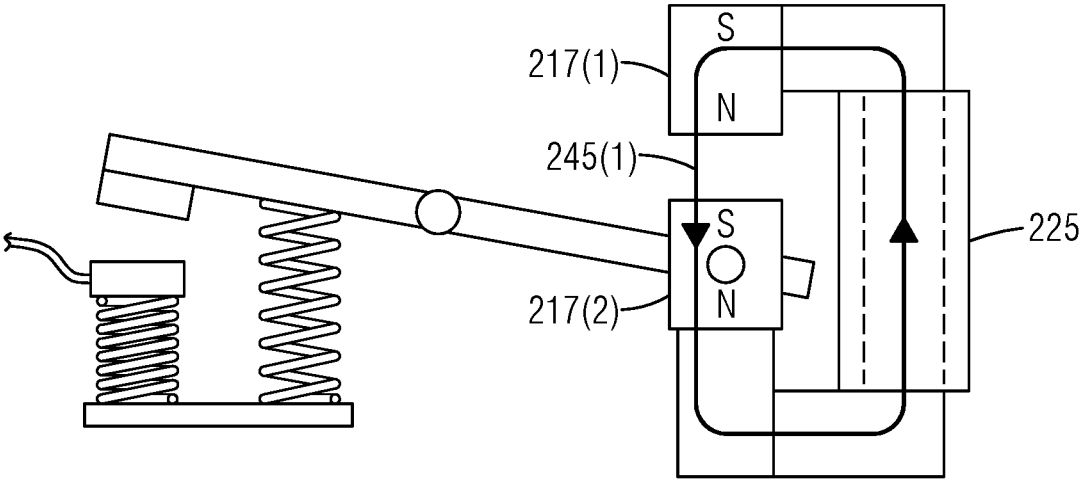
FIG. 2 illustrates a coil is energized to enhance magnetic fields of permanent magnets in accordance with an exemplary embodiment of the present invention.

Referring to FIG. 2, it illustrates a coil 225 that is energized to enhance magnetic fields of permanent magnets 217(1-2) in accordance with an exemplary embodiment of the present invention. This invention presents an air gap mechanism that is permanent magnet based. When, the coil 225 is energized a first direction magnetic field 245(1) is generated to enhance the magnetic fields of permanent magnets 217(1-2).

Figure 3:
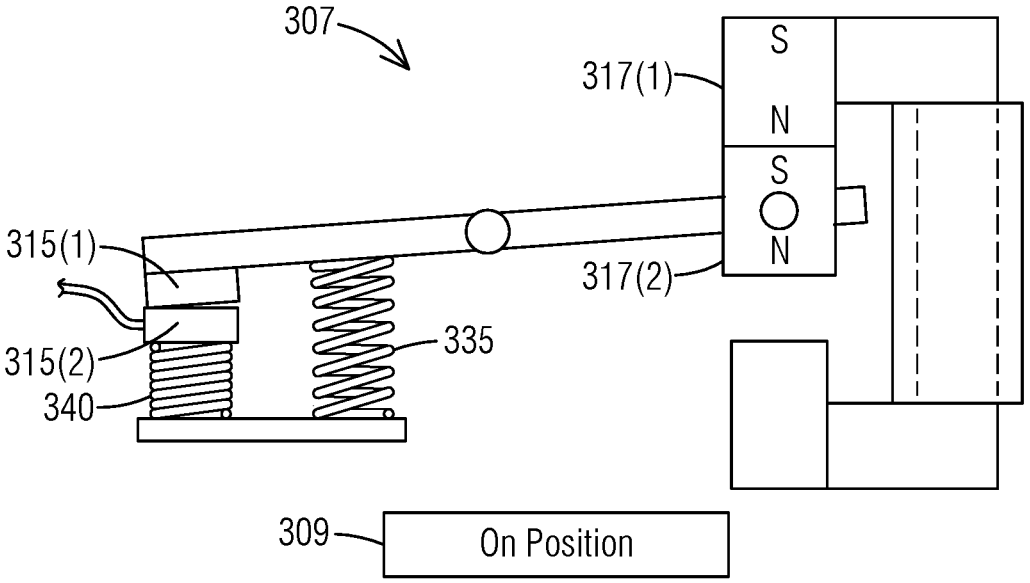
FIG. 3 illustrates a solid-state circuit breaker in an ON position (contacts closed) in accordance with an exemplary embodiment of the present invention.

Turning now to FIG. 3, it illustrates a solid-state circuit breaker 307 in an ON position 309 (contacts closed) in accordance with an exemplary embodiment of the present invention. With first and second magnets 317(1-2) now in touch with each other, the magnetic force between them is strong enough to overcome a reset spring 335 and a contact force spring 340 and it can hold contacts 315(1-2) closed. The breaker 307 is then in the ON position 309.

Figure 4:
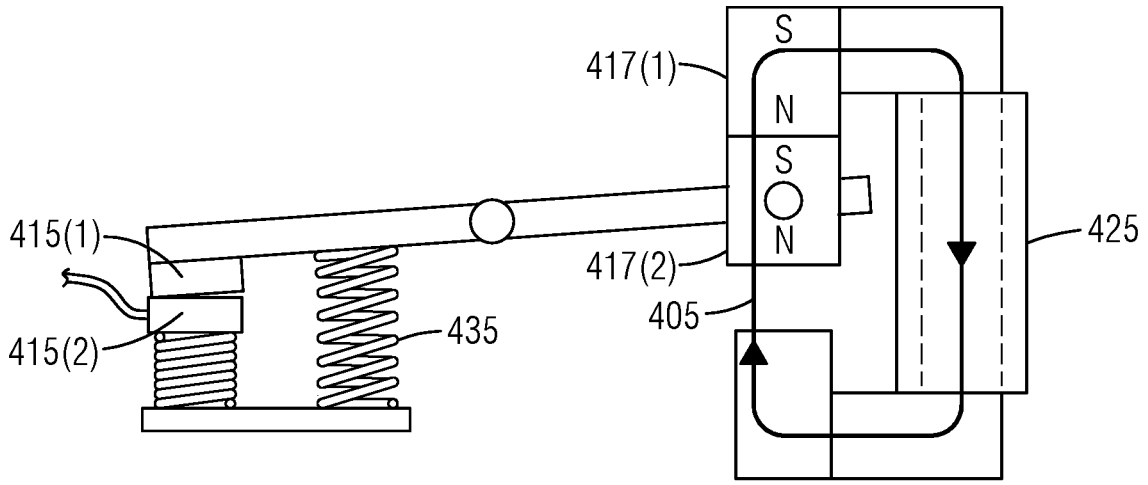
FIG. 4 illustrates a coil is energized to cancel magnetic fields for permanent magnets in accordance with an exemplary embodiment of the present invention.

FIG. 4 illustrates a coil 425 is energized to cancel magnetic fields for permanent magnets 417(1-2) in accordance with an exemplary embodiment of the present invention. A coil magnetic field 405 cancels the magnetic field of both permanent magnets 417(1-2), and hence eliminate the attraction force between the two. A reset spring 435 can then open contacts 415(1-2).

Figure 5:
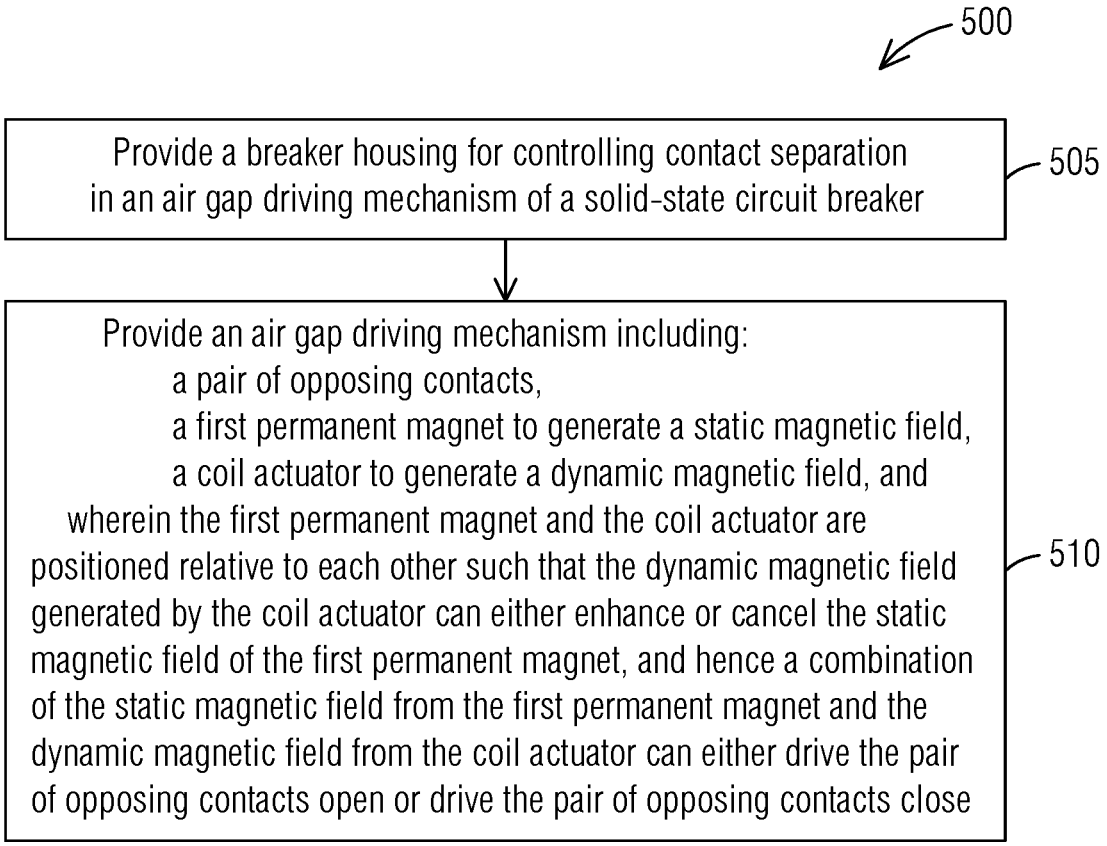
FIG. 5 illustrates a schematic view of a flow chart of a method of controlling contact separation in an air gap driving mechanism in accordance with an exemplary embodiment of the present invention.

As seen in FIG. 5, it illustrates a schematic view of a flow chart of a method 500 of controlling contact separation in the air gap driving mechanism 105 in accordance with an exemplary embodiment of the present invention. Reference is made to the elements and features described in FIGS. 1-4. It should be appreciated that some steps are not required to be performed in any particular order, and that some steps are optional.

The method 500 comprises a step 505 of providing a breaker housing. The method 500 further comprises a step 510 of providing an air gap driving mechanism including: a pair of opposing contacts, a first permanent magnet to generate a static magnetic field and a coil actuator to generate a dynamic magnetic field. The first permanent magnet and the coil actuator are positioned relative to each other such that the dynamic magnetic field generated by the coil actuator can either enhance or cancel the static magnetic field of the first permanent magnet, and hence a combination of the static magnetic field from the first permanent magnet and the dynamic magnetic field from the coil actuator can either drive the pair of opposing contacts open or drive the pair of opposing contacts close.

While a design in which by using a permanent magnet both ON and OFF operations can be achieved with a single actuator is described here a range of one or more other air gap driving mechanisms are also contemplated by the present invention. For example, other air gap driving mechanisms may be implemented based on one or more features presented above without deviating from the spirit of the present invention.

The techniques described herein can be particularly useful for a coil that is energized to enhance magnetic fields of permanent magnets or the coil is energized to cancel magnetic fields for permanent magnets. While particular embodiments are described in terms of two permanent magnets, the techniques described herein are not limited to such arrangement but can also be used with other arrangements.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A solid-state circuit breaker comprising:

a breaker housing; and an air gap driving mechanism including:

a pair of opposing contacts, a first permanent magnet to generate a static magnetic field, a coil actuator to generate a dynamic magnetic field, and wherein the first permanent magnet and the coil actuator are positioned relative to each other such that the dynamic magnetic field generated by the coil actuator can either enhance or cancel the static magnetic field of the first permanent magnet, and hence a combination of the static magnetic field from the first permanent magnet and the dynamic magnetic field from the coil actuator can either drive the pair of opposing contacts open or drive the pair of opposing contacts close.

2. The solid-state circuit breaker of claim 1, wherein the coil actuator consists of a coil and a ferromagnetic core and is fixed in the breaker housing.

3. The solid-state circuit breaker of claim 2, wherein the first permanent magnet is fixed to one end of the ferromagnetic core and a non-magnetic stop is attached to the other end.

4. The solid-state circuit breaker of claim 1, further comprising:

a contact arm that is pivotally mounted in the breaker housing such that on one end of the contact arm a second permanent magnet is pivotally mounted, wherein the second permanent magnet can be attracted by the first permanent magnet such that the second permanent magnet provides stronger interaction with the first permanent magnet.

5. The solid-state circuit breaker of claim 4, wherein on the other end of the contact arm a contact of the pair of opposing contacts is mounted which can close and open with a stationary contact of the pair of opposing contacts to close and open a current path.

6. The solid-state circuit breaker of claim 5, further comprising:

a reset spring that acts on the contact arm in a manner that it always tries to push the pair of opposing contacts open for fail safe purpose.

7. The solid-state circuit breaker of claim 6, further comprising:

a contact force spring that is loaded behind the stationary contact of the pair of opposing contacts to provide a necessary contact force.

8. The solid-state circuit breaker of claim 7, wherein in an OFF position the coil actuator is not energized so the pair of opposing contacts are held open by the reset spring.

9. The solid-state circuit breaker of claim 8, wherein from the OFF position if it is decided to close the pair of opposing contacts, the coil actuator is energized with a current direction in such a way that a first magnetic field is generated such that a magnetic field strength of the first permanent magnet is enhanced so it can attract the second permanent magnet to overcome the reset spring and eventually to close the pair of opposing contacts.

10. The solid-state circuit breaker of claim 9, wherein with the first and the second permanent magnets now in touch with each other a magnetic force between them is strong enough to overcome the reset spring and the contact force spring which can hold the pair of opposing contacts closed and the solid-state circuit breaker is then in an ON position.

11. The solid-state circuit breaker of claim 10, wherein from the ON position if it is decided to open the pair of opposing contacts, an opposite direction current is provided to the coil to generate a second magnetic field that is opposite to the first magnetic field such that a coil magnetic field cancels a magnetic field of both the first and the second permanent magnets, and hence eliminate an attraction force between the two causing the reset spring to then open the pair of opposing contacts.

12. The solid-state circuit breaker of claim 11, further comprising:

a manual override to manually push the second permanent magnet away from the first permanent magnet in the ON position and hence to open the pair of opposing contacts in case of electronics failure.

13. The solid-state circuit breaker of claim 1, further comprising:

a lockout feature in that before the pair of opposing contacts are closed, a self-test can be run to check the condition of components and circuitry and the pair of opposing contacts can be closed through the coil actuator only after the self-test passes whereas in case of the self-test failure, a control unit of the solid-state circuit breaker does not send current to the coil actuator so the pair of opposing contacts do not close.

14. The solid-state circuit breaker of claim 1, wherein the contact separation is put inside a vacuum condition.

15. The solid-state circuit breaker of claim 1, wherein the air gap driving mechanism is placed in a vacuum tube as a whole.

16. A method of controlling contact separation in an air gap driving mechanism of a solid-state circuit breaker, the method comprising:

providing a breaker housing; and providing an air gap driving mechanism including:

a pair of opposing contacts, a first permanent magnet to generate a static magnetic field, a coil actuator to generate a dynamic magnetic field, and wherein the first permanent magnet and the coil actuator are positioned relative to each other such that the dynamic magnetic field generated by the coil actuator can either enhance or cancel the static magnetic field of the first permanent magnet, and hence a combination of the static magnetic field from the first permanent magnet and the dynamic magnetic field from the coil actuator can either drive the pair of opposing contacts open or drive the pair of opposing contacts close.

17. The method of claim 16, wherein the coil actuator consists of a coil and a ferromagnetic core and is fixed in the breaker housing.

18. The method of claim 17, wherein the first permanent magnet is fixed to one end of the ferromagnetic core and a non-magnetic stop is attached to the other end.

19. The method of claim 16, further comprising:

providing a contact arm that is pivotally mounted in the breaker housing such that on one end of the contact arm a second permanent magnet is pivotally mounted, wherein the second permanent magnet can be attracted by the first permanent magnet such that the second permanent magnet provides stronger interaction with the first permanent magnet.

20. The method of claim 19, wherein on the other end of the contact arm a contact of the pair of opposing contacts is mounted which can close and open with a stationary contact of the pair of opposing contacts to close and open a current path.

* * * * *